US006092377A

United States Patent [19]

Tso

[11] Patent Number: 6,092,377

[45] Date of Patent: Jul. 25, 2000

[54] AIR COOLED TWO STAGE CONDENSER FOR AIR CONDITIONING AND REFRIGERATION SYSTEM

[76] Inventor: Ming-Li Tso, No. 30, Lane 6, Ling Yun Street, Nan Gang, Taipei, Taiwan

[21] Appl. No.: 09/322,923

[22] Filed: Jun. 1, 1999

[51] Int. Cl.[7] ..... F24F 3/14

[52] U.S. Cl. ..... 62/173; 62/262; 62/238.6; 165/122

[58] Field of Search ..... 62/173, 262, 238.6; 165/61, 122

[56] References Cited

U.S. PATENT DOCUMENTS

| | | | |
|---|---|---|---|
| 2,770,100 | 11/1956 | Raney | 62/173 |
| 2,885,142 | 5/1959 | Eberhart | 62/262 |
| 2,952,989 | 9/1960 | Gould et al. | 62/173 |
| 3,105,366 | 10/1963 | Atchison | 62/173 |
| 3,460,353 | 8/1969 | Ogata et al. | 62/173 |
| 3,520,147 | 7/1970 | Glackman | 62/173 |
| 3,635,046 | 1/1972 | Sato et al. | 62/173 |
| 3,738,117 | 6/1973 | Engel | 62/173 |
| 4,102,148 | 7/1978 | Matthews et al. | 62/298 |
| 4,382,368 | 5/1983 | Dittell | 62/238.6 |
| 4,409,794 | 10/1983 | Kitani | 62/238.6 |
| 5,195,328 | 3/1993 | Davis | 62/238.6 |
| 5,638,693 | 6/1997 | Baek | 62/262 |

FOREIGN PATENT DOCUMENTS

| | | | |
|---|---|---|---|
| 0041729 | 3/1984 | Japan | 62/173 |
| 0909458 | 2/1982 | U.S.S.R. | 62/173 |

*Primary Examiner*—John K. Ford
*Attorney, Agent, or Firm*—Dougherty & Troxell

[57] ABSTRACT

An air cooled two stage condenser constructure for air conditioning and refrigeration system which including a casing define a first chamber and a second chamber, each chamber having a respective air intake port and a respective exhaust port, a refrigerant circulation tubing installed in the casing divided into two sections with connection, one is for condenser and other is for heat exchange, a compressor mounted inside the casing and controlled to pump the refrigerant, a fan motor mounted inside the casing, a fan blade installed in the first chamber and rotated by the fan motor to cause currents of air through heat exchanger coil toward the first exhaust port, and a wind wheel installed in the casing and rotated by the fan motor to suck currents of air from the first air intake port of the second chamber through the condenser coil toward the second exhaust port of the first chamber.

5 Claims, 7 Drawing Sheets

AIR COOLED TWO STAGE CONDENSER FOR AIR CONDITIONING AND REFRIGERATION SYSTEM

BACKGROUND OF THE INVENTION

The present invention relates to an air cooled two stage condenser construction for air conditioning and refrigeration system.

Regularly, air conditioning/refrigeration include two types, namely, the air cooled type and the water chilled type. Because the heat dissipation effect of an air cooled type air conditioning/refrigeration tends to be affected by the surrounding environment, the cooling effect of an air cooled type air conditioning/refrigeration is less efficient. A water chilled type air conditioning/refrigeration provides a relatively better cooling effect because it uses cold water to make a heat exchange with the refrigerant. However, the installation cost of water cooled type air conditioning/refrigeration is high. For cost's sake, air cooled type air conditioning/refrigeration is more popularly accepted. FIG. 1 shows an out door main unit for an air cooled type air conditioning/refrigeration according to the prior art. The outdoor main unit comprises condenser coil A, and a fan B suspended behind the condense coil A and controlled to suck outside air into the inside through gaps in the condenser coil A. This design can not effectively carry heat away from the condenser coil A. Further, because of the fan motor for the fan B directly receives hot currents of air, it performance become low after getting hot. FIG. 2 shows another structure of outdoor main unit for an air cooled type air conditioning/refrigeration according to the prior art. According to this structure of outdoor main unit, the fan D is disposed in front of the condenser coil C. When operated, the fan D cause currents of the air toward the condenser coil C. Another drawback of this structure of the outdoor main unit is that the condenser coils tend to be covered with dust, thereby causing the heat exchanging effect to be affected.

SUMMARY OF THE INVENTION

The present invention has been accomplished to provide an outdoor main unit for an air cooled type air conditioning/refrigeration, which eliminates the aforesaid drawback, by the two stage condenser construction for air conditioning an refrigeration system. According to one aspect of the present invention, the outdoor main unit for an air cooled type air conditioning/refrigeration comprises a casing define a first chamber and a second chamber, each chamber having the respective air intake port and a respective exhaust port, a refrigerant circulation tubing installed in the casing for circulation of refrigerant, said refrigerant tubing having condenser coil and a main heat exchange coil respectively suspended in the two chambers in the casing, a compressor mounted inside the casing and controlled to pump the refrigerant through the refrigerant tubing, a fan motor mounted inside the casing, a fan blade installed in the first chamber and rotated by the fan motor to cause currents of air through the main heat exchanger coil toward the exhaust port of the first chamber, and a wind wheel installed in the casing and rotated by the fan motor to suck currents of air from the air intake port of the second chamber through the condenser coil toward the exhaust port of the first chamber. According to another aspect of the present invention, the number of turns of the condenser coils is greater than the number of turns of the main heat exchanger coil, and therefore the main heat exchanger coil produces less resistance to the air movement passing through. Because the refrigerant circulation tube is divided into a condenser coil and a main heat exchanger coil respectively suspended in different chambers in the casing, the condensing efficiency is greatly improved, and power consumption is greatly saved.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
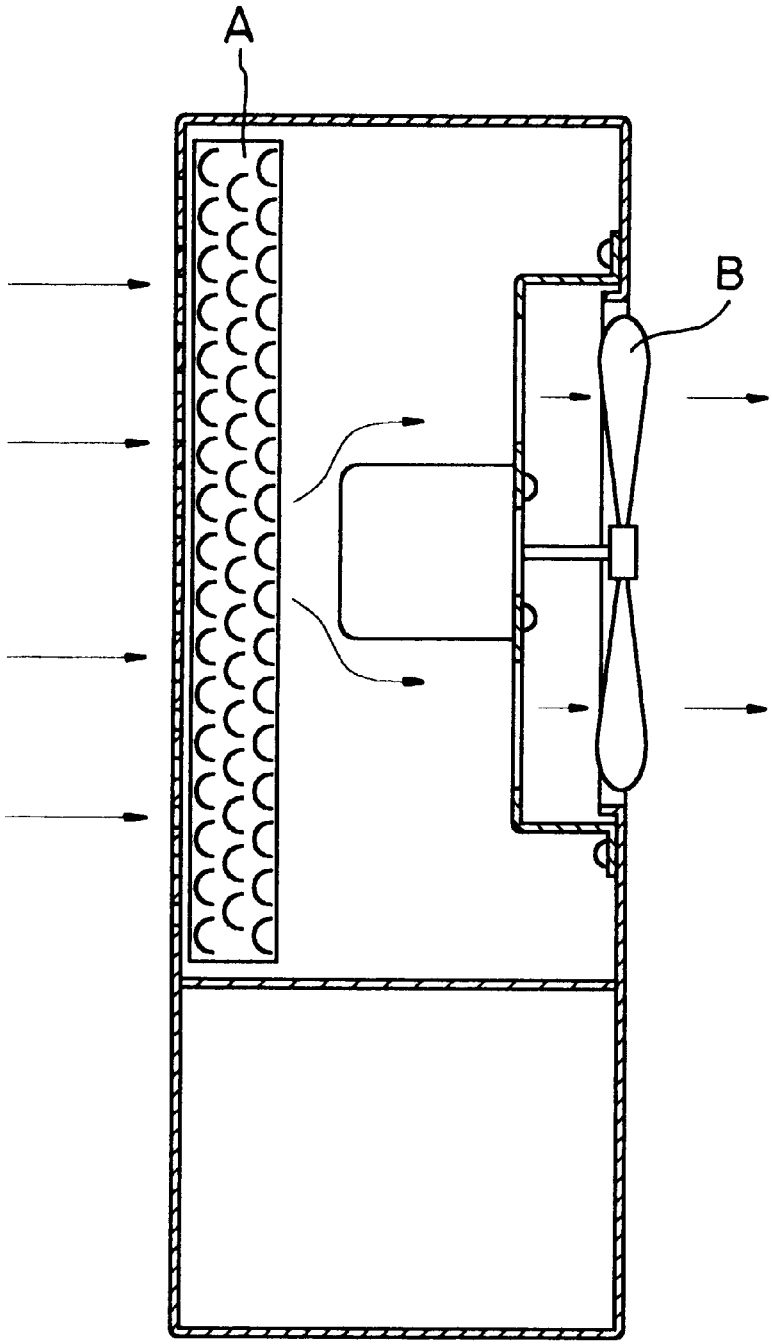
(PRIOR ART) FIG. 1
FIG. 1 is a sectional view showing an outdoor main unit for an air cooled type air conditioning/refrigeration according to the prior art.
Figure 2:
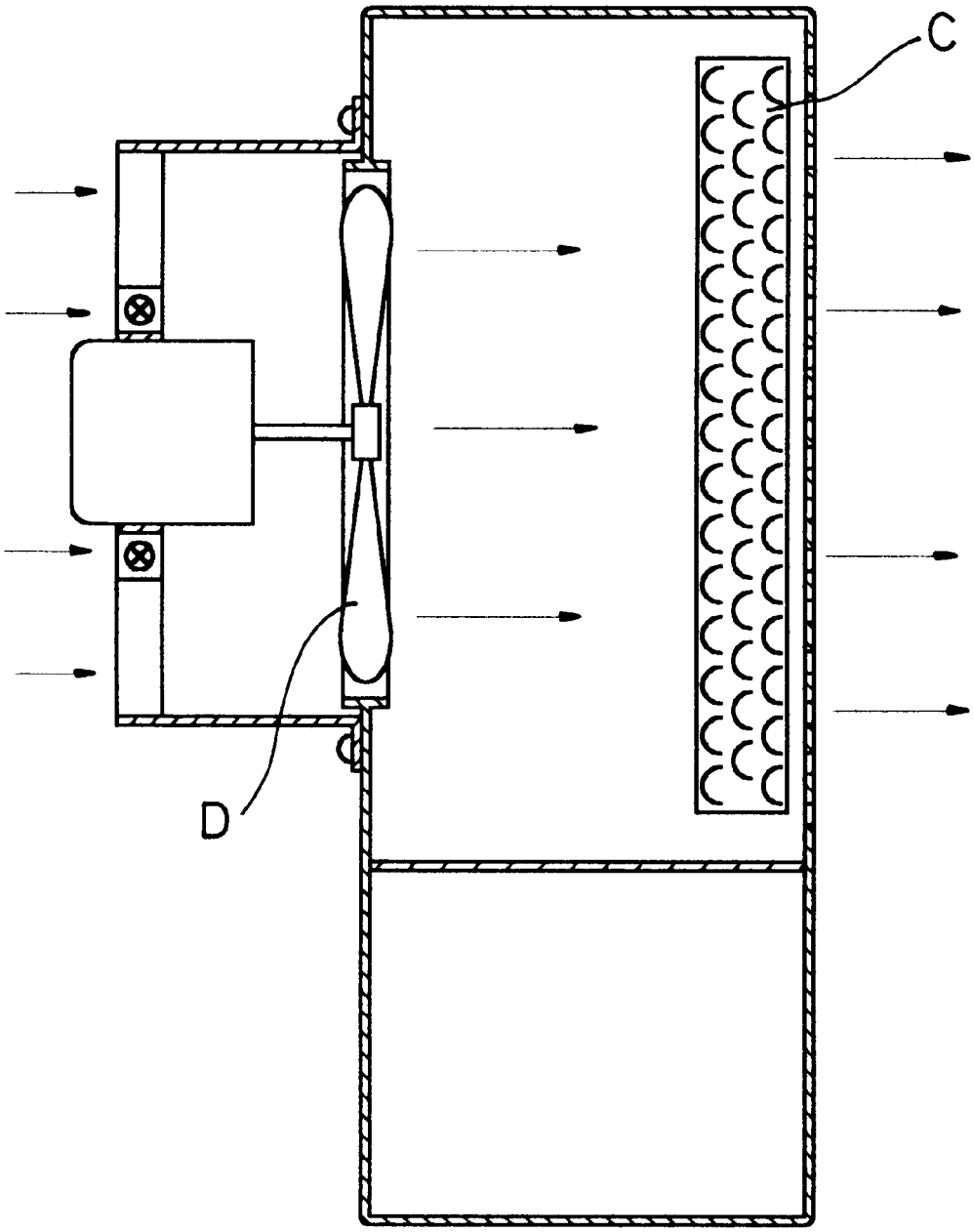
(PRIOR ART) FIG. 2
FIG. 2 is a sectional view showing another structure of outdoor main unit for an air cooled type air conditioning/refrigeration system according to the prior art.
Figure 3:
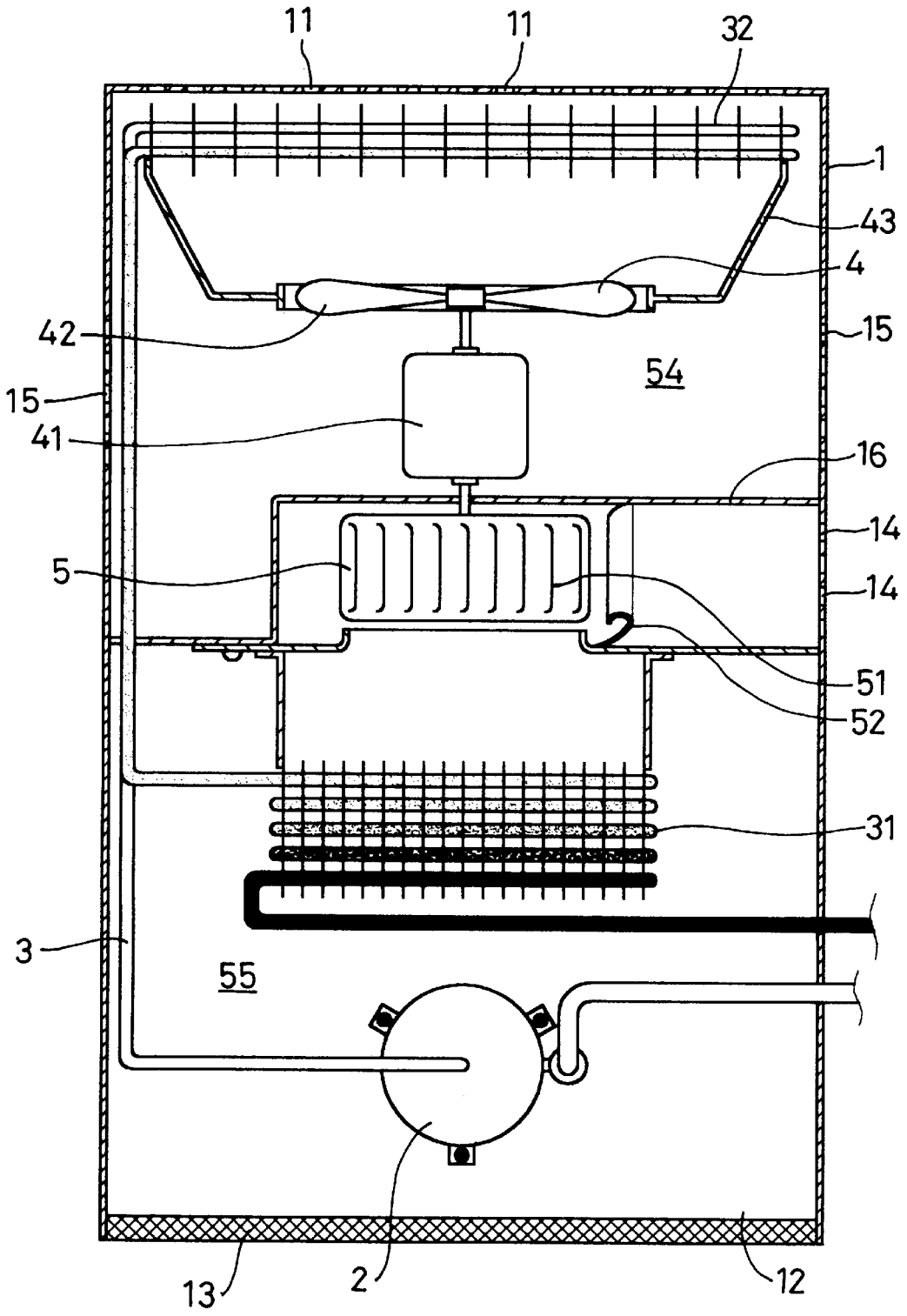
FIG. 3 is a sectional view showing an outdoor main unit for an air cooled type air conditioning/refrigeration system according to the present invention.

Referring to FIG. 3, an outdoor main unit for an air cooled type air conditioning/refrigeration in accordance with the present invention is shown comprised of a casing 1, a compressor 2, a refrigerant circulation tubing 3, a fan 4, and a wind wheel 5. The compressor 2, refrigerant circulation tubing 3, fan 4 and wind wheel 5 are mounted inside the casing 1.

The casing 1 comprises a first exhaust port 11 for air discharge, and a first air intake port 12 for air input at two opposite end thereof, a wire gauze filter 13 covered on the air intake port 12 to remove solid matter form air passing through, a second exhaust port 14 for air discharge at one lateral side thereof on the middle, a second air intake port 15 for air input at two opposite lateral sides thereof in communication with the first exhaust port 11, and a partition board 16 disposed between the second exhaust port 14 and the second air intake port 15. The partition boar 16 separates the holding space of the casing 1 into two enclosed, independent spaces, namely, the first enclosed space and the second enclosed space. That means, the casing 1 is divided into two connected sections and each one means a stage in either heat exchanging or condensing stage.

The compressor 2 is conventional and connecting with refrigerant circulation tubing 3 for circulation. However, this is conventional art and not been further disclosed.

The refrigerant circulation tubing 3 is also the conventional art. Basically, divided by said partition 16, there is condenser coil 31 suspended in the second section which within the same space of compressor 2, and the main heat exchanger coil 32 which within the first section and in the same space of fan 4. The tail end of the refrigerant circulation tubing 3 is extending out of the casing 1 and further connected to the split indoor units of the air conditioning/refrigeration system.

The fan 4 is installed in the first section inside the casing 1 adjacent to the first exhaust port 11 and behind the said main heat exchanger coil 32 comprised of a fan motor 41 to drive a fan blade 42 for rotation. Suspending around the fan blade 42, provides a heat dissipating fan shell 43 to ensure the currents of air which intaken by the fan blade 42 can blow toward to the main heat exchanger coil 32 and the first exhaust port 11.

The wind wheel 5 is a wheel like shape suspended in the second enclosed space inside the casing 1, the wind wheel 5 having a plurality of narrow transverse slots 51 spaced around the periphery. It is driven by the said fan motor 41, that means, during the fan motor 41 is rotating, the fan blade 42 and wind wheel 5 are rotating simultaneously. Further, wind guide 52 is installed inside the casing 1 around the wind wheel 5. Said wind guide 52 guides currents of air from the wind wheel 5 to the outside of the casing 1 through the second exhaust port 14.

Please refer to the drawings, in practice, when switch on the power, said compressor 2 and fan motor 41 works, the refrigerant is circulated through the refrigerant circulation tubing 3, outside air is intaken to the inside of casing 1 through the second air intake port 15, through fan blade 42 then blowing toward main heat exchanger coil 32 and discharging from the first exhaust port 11. This is the route of hot dissipating air of the first stage. In the mean time, the outside air is intaken from the first air intake port 12, and cooling the condenser coil 31, then, wind wheel 5 discharging the hot air to outside of casing 1 through second exhaust port 14. This is the heat of the refrigeration operation of second stage and it can be carried our repeatedly and simultaneously.

As for the route of refrigerant, once is pumped out by the compressor, it flows through the main heat exchanger coil 32 in a certain high speed, then, the heat dissipated by the air blown from the fan 4, and when flowing through the condenser coil 31, the refrigerant becomes refrigerated status, at the meantime, the refrigerant further cooled by the intake air from intake port 12. The refrigerant finally becomes fully refrigerated which shown as black past of drawings. Then, it flows to the split indoor units for air conditioning and refrigeration.

Figure 4:
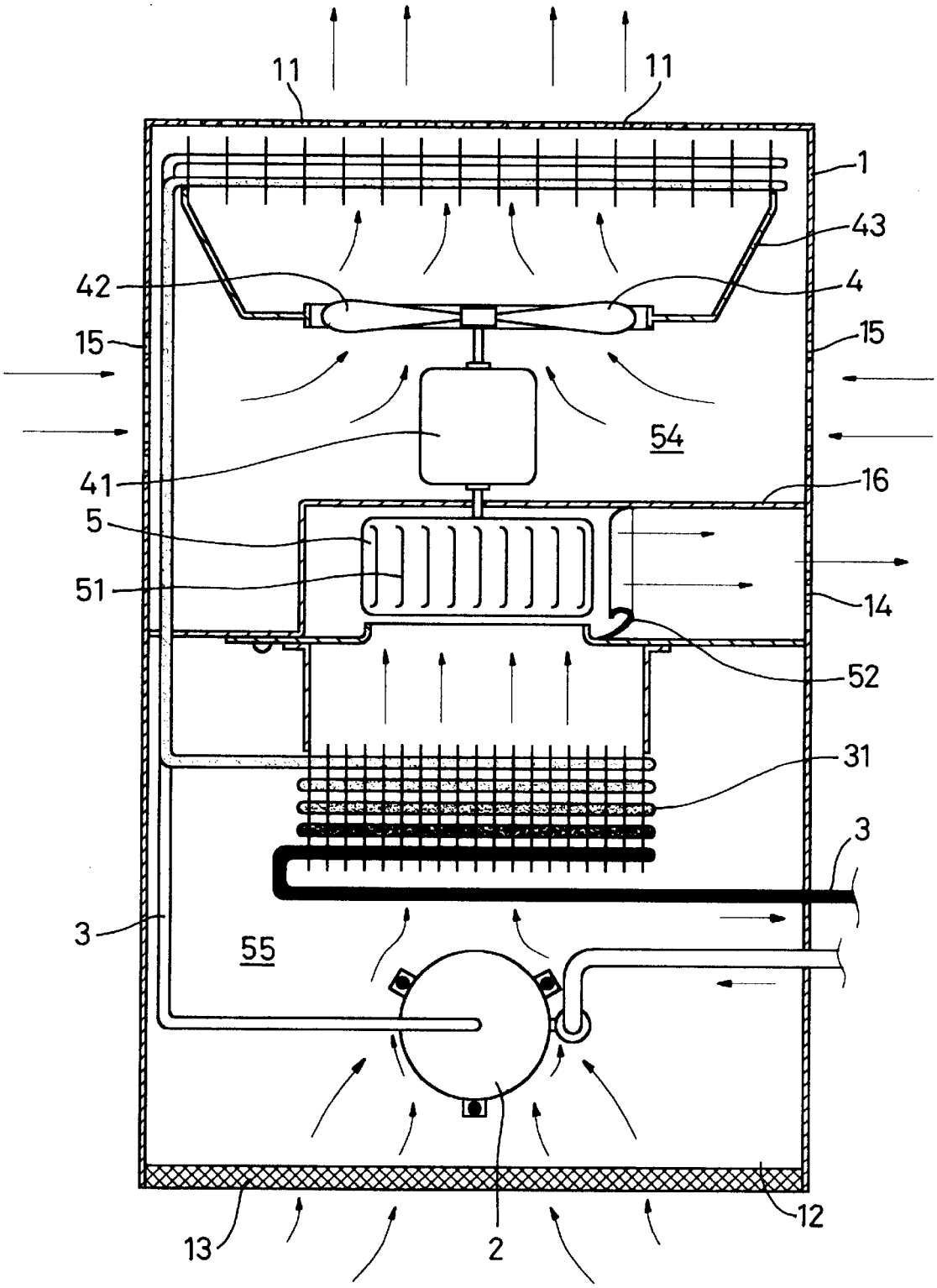
FIG. 4 illustrates the flowing directions of currents of air when the outdoor main unit of FIG. 3 operated.

Refer to the drawings, as for the route of air, when the intake air comes from the intake port 12 positioned in the place near the compressor 2 and pass through condenser coil 31 then sucked out through the wind wheel 5 and discharged to the second exhaust port 14. The another air for heat exchange intake air enters from the second air intake port 15 and flow through fan 4, then flows through the main heat exchanger coil 32 and flows out of the casing 1 from the first exhaust port 11. The arrows in FIG. 4 show the direction of the air.

Figure 5:
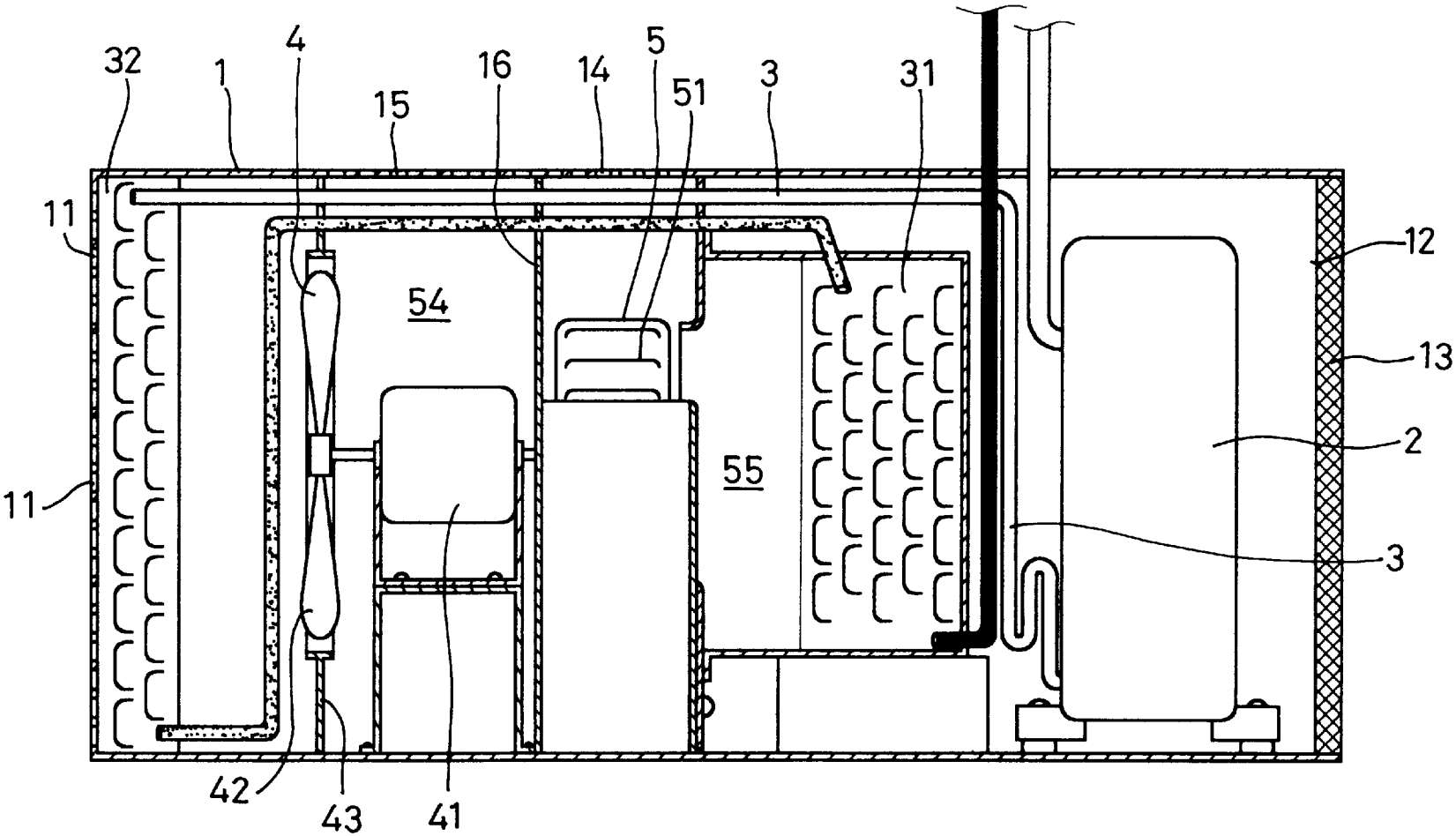
FIG. 5 is a sectional view of an alternate form of the present invention.
Figure 6:
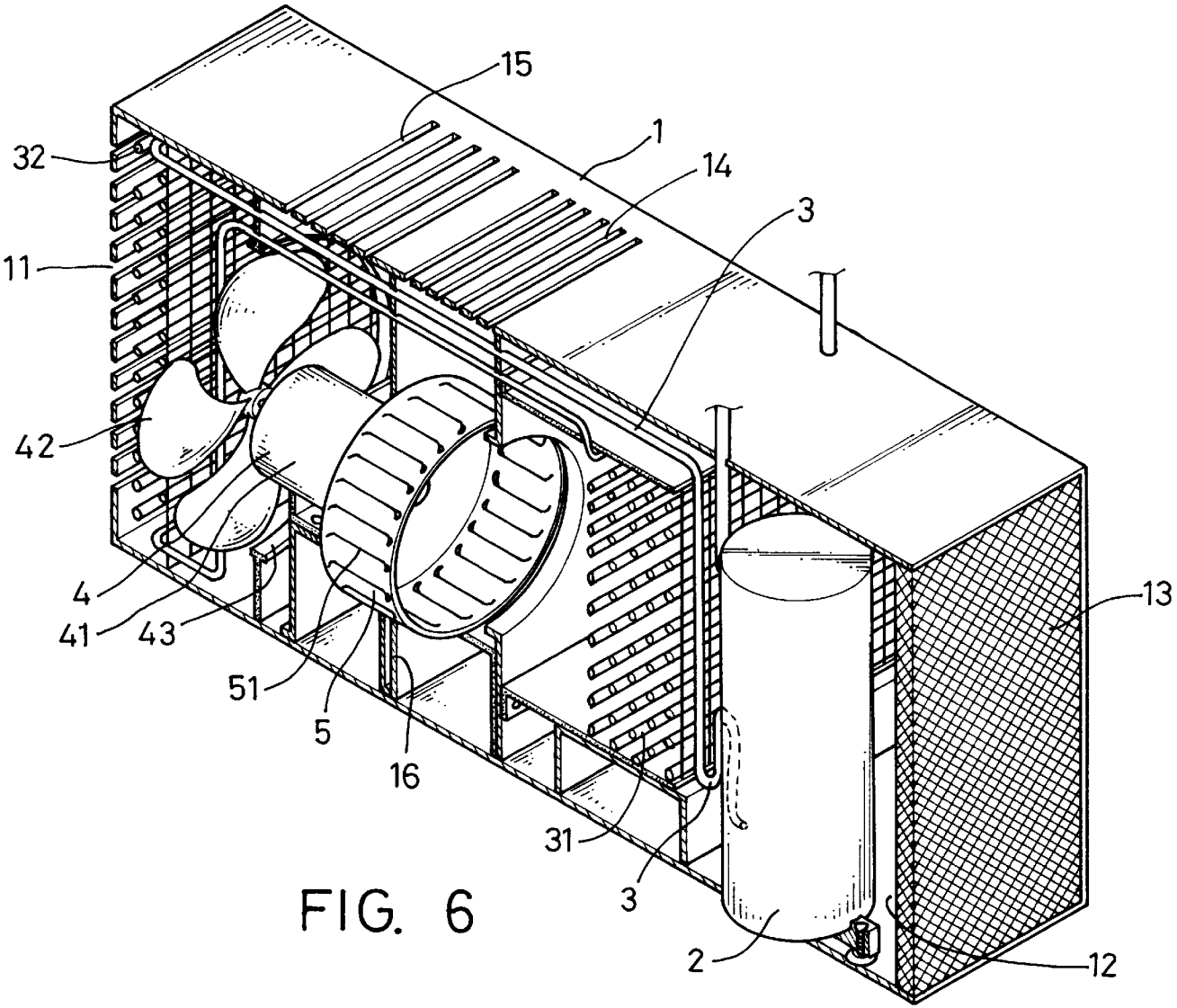
FIG. 6 is a perspective view of FIG. 5.

FIGS. 5 and 6 show the other embodiment of the present invention under horizontal design. Excepts of the positioning arrangement, all of the operations and proceeding are identical to the aforesaid vertical type.

Figure 7:
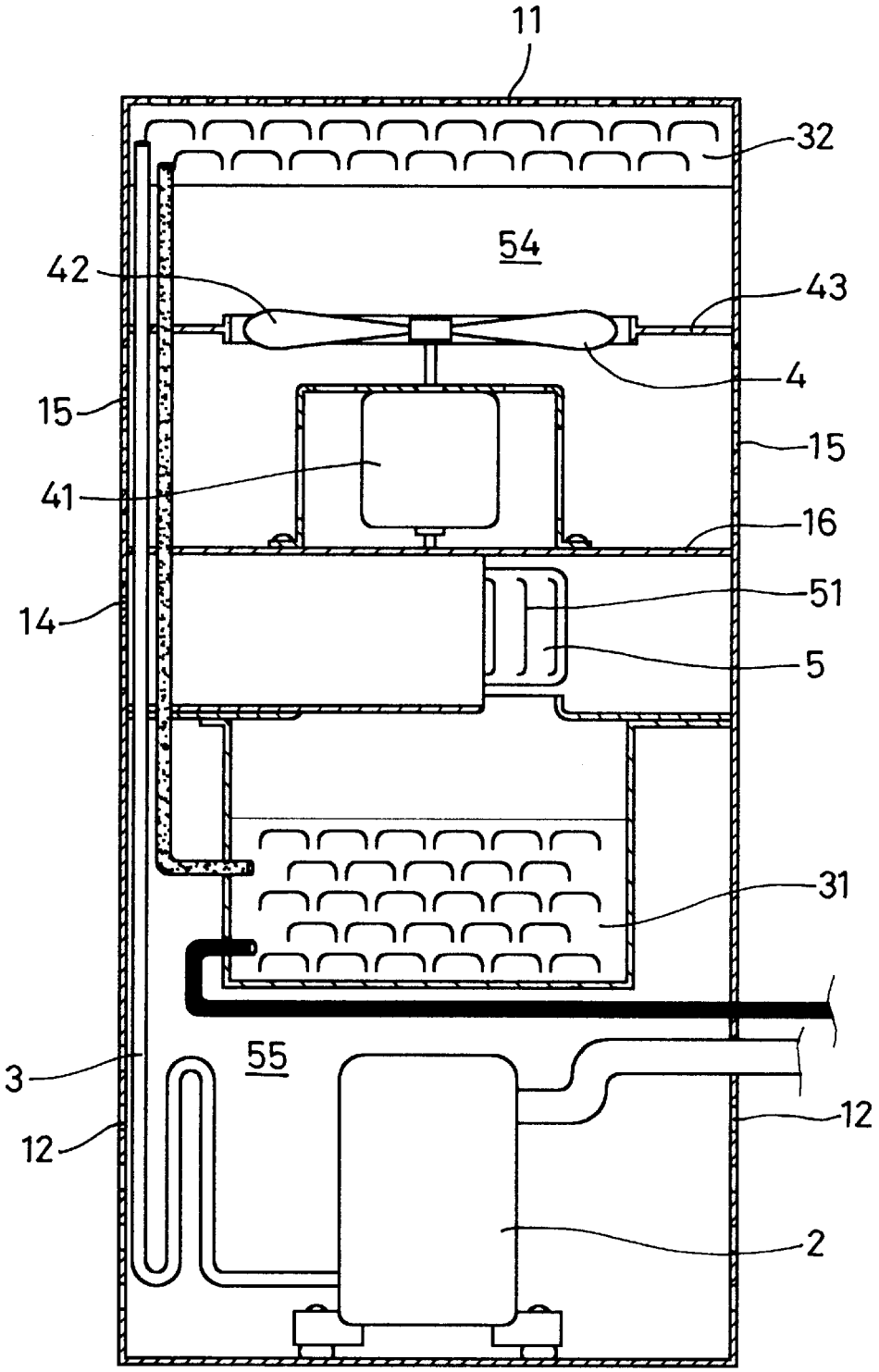
FIG. 7 is a sectional view of another alternate form of the present invention.

FIG. 7 shows the equivalent arrangement which caused by the different mode of compressor 2. However, the basic principle and operation is identical to the above-mentioned embodiment.

Thus, by the practice of the present invention, the effects which can be obtained as:

1) Dividing the route of refrigerant into independent two sections, namely condensing and heat exchanging stage, which can cool the refrigerant effectively and increase the refrigeration efficiency. This is no able to achieved by the conventional air conditioning/refrigeration apparatus.
2) Due to the high speed and temperature of refrigerant, therefore, the route of heat exchange is more longer but fewer number in coil. Because of the high temperature difference, therefore, by the wider- faced fan to blows out the huge air and fewer coil to reduce the air resistance, the air will flows in more speedy to eliminate the drawback of air circulation of conventional art. Due to the refrigerant which had been coiled must be condensed, therefore, the condensing coil provided in more coils. And because the temperature difference is lesser, therefore, the refrigerant flows more slowly. It is to be noted that the wind wheel used in the present invention is the key feature which can eliminate the existing drawback of heat exchange and refrigeration and meet the requirements of air conditioning/refrigeration condition.
3) Dividing the air for heat exchange and refrigeration into two separate areas to promote the cooling efficiency, which enable to make the high amperage of compressor lower, decrease electricity consumption, enlarge the refrigeration ability, shorten the operation time and save the electricity consumption. Furthermore, by using the same motor for power supply of the fan for conditioning and refrigeration, which enable the motor in the largest output utility, and ensure the maintenance of the motor in operation. These functional result are not achievable by the convention art.

It is to be understood that the disclosed embodiment and drawings are designed for the illustration only, any equivalent practice which based on the principle and operation of the will be within the scope of the present invention.

Which I claim:

1. An air cooled two stage condenser for an air conditioning and refrigeration system comprising:

a) a casing having a partition board dividing an interior of the casing into first and second chambers, the casing further having first air intake port and first air exhaust port communicating with the first chamber, and second air intake port and second air exhaust port communicating with the second chamber;

b) a main heat exchanger coil in the first chamber for dissipating heat from a refrigerant therein;

c) a condenser coil located in the second chamber for cooling a refrigerant therein;

d) a compressor located in the casing;

e) refrigerant circulation tubing connecting an outlet of the compressor to the main heat exchanger coil and the main heat exchanger coil to the condenser coil whereby refrigerant flows from the compressor, to the main heat exchanger coil, and from the main heat exchanger coil to the condenser coil;

f) a motor located in the casing;

g) an axial fan located in the first chamber and driven by the motor, the axial fan drawing air into the casing through the first air intake port, blowing air over the main heat exchanger coil to cool the refrigerant therein, and out through the first air exhaust port; and, h) a centrifugal fan located in the second chamber and driven by the motor to draw air into the casing through the second intake port, passing the air over condenser coil to further cool the refrigerant therein and out through the second air exhaust port.

2. The air cooled, two stage condenser of claim 1 further comprising a fan shell extending between the axial fan and the main heat exchanger coil to direct air from the axial fan onto the main heat exchanger coil.

3. The air cooled, two stage condenser of claim 1 wherein the casing has a top, lateral sides and a bottom, and wherein the first air exhaust port is located in the top; the first air intake port and the second air exhaust port are located in the lateral sides; and the second air intake port is located in the bottom.

4. The air cooled, two stage condenser of claim 1 wherein the casing has a top, lateral sides and a bottom and wherein the first air exhaust port and the second air intake port are located in the lateral sides; and the first air intake port and second air exhaust port are located in the top.

5. The air cooled, two stage condenser of claim 1 wherein the casing has a top, lateral sides and a bottom, and wherein the first air exhaust port is located in the top; and wherein the first air intake port, the second air intake port and the second air exhaust port are located in the lateral sides.

* * * * *